United States Patent [19]

Kamstrup-Larsen

[11] 4,015,929

[45] Apr. 5, 1977

[54] ROTARY KILN FOR PRODUCING AN EXPANDED CLAY PRODUCT AND A METHOD OF MANUFACTURING THE ROTARY KILN

[75] Inventor: Harry Kamstrup-Larsen, Vanlose, Denmark

[73] Assignee: Leca Trading & Concession A/S, Denmark

[22] Filed: Dec. 15, 1975

[21] Appl. No.: 640,927

[30] Foreign Application Priority Data

Jan. 23, 1975 Denmark ..... 214/75

[52] U.S. Cl. ..... 432/3; 432/118; 432/119; 259/81 R; 241/183

[51] Int. Cl.[2] ..... F27B 7/14

[58] Field of Search ..... 432/3, 76, 103, 105, 432/108, 118, 119, 248; 241/181, 183; 51/163, 164; 259/81 R

[56] References Cited

UNITED STATES PATENTS

| | | | |
|---|---|---|---|
| 609,920 | 8/1898 | Stowe | 432/119 |
| 1,188,203 | 6/1916 | Peterson et al. | 241/183 |
| 1,910,873 | 5/1933 | Zahn | 432/118 |
| 2,084,713 | 6/1937 | Thayer | 432/103 |
| 2,190,271 | 2/1940 | Powell | 432/108 |
| 3,563,521 | 2/1971 | Olsen | 432/118 |
| 3,853,458 | 12/1974 | Wurr et al. | 432/118 |
| 3,930,916 | 1/1976 | Shelley | 110/1 A |

*Primary Examiner*—John J. Camby
*Assistant Examiner*—Henry C. Yuen
*Attorney, Agent, or Firm*—Cushman, Darby & Cushman

[57] ABSTRACT

A rotary kiln for producing an expanded clay product from clay or clay slate, the kiln having a lining provided with ribs. These ribs are built of refractory bricks partly reinforced. Each brick is preferably constituted by two portions, one of which is provided with reinforcing bars extending within and protruding from said portion. The protruding bars serve as guide for the second brick portion during the securing of the two brick portions to each other. The advantage of such a rib construction is that it allows an easy and cheap restoration of the rib when part of the rib is worn down without simultaneously necessitating a replacement of the lining.

10 Claims, 5 Drawing Figures

Figure 1:
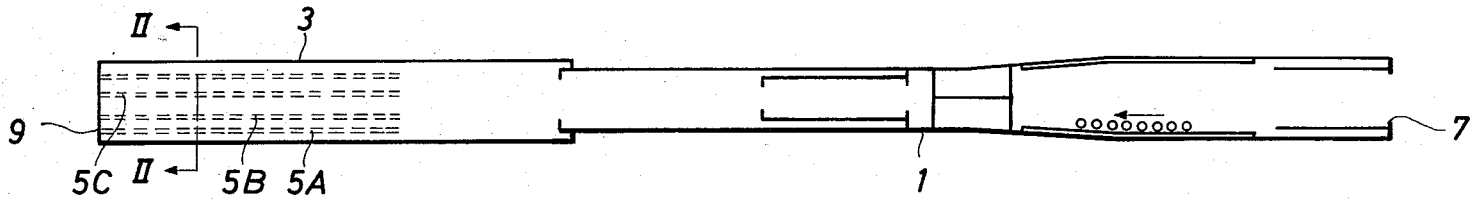

ROTARY KILN FOR PRODUCING AN EXPANDED CLAY PRODUCT AND A METHOD OF MANUFACTURING THE ROTARY KILN

The present invention relates to a rotary kiln for producing an expanded clay product from clay or clay slate, comprising a firing section, the peripheral speed of which is rather great, a drying section, if any, arranged in continuation thereof, the peripheral speed of which is rather low, and ribs of refractory bricks mounted in the firing section and protruding radially relative to the lining so as to move the clay product.

Rotary kilns are shown, in which the firing section especially the part adjacent the discharge end is provided with ribs protruding radially inwards relative to the lining, and stirring the clay in the kiln in such manner that the clay granules are completely pervaded by hot flue gas. The ribs of refractory bricks or blocks are, however, exposed to hard wear. This wear necessitates a replacement of the bricks or blocks substantially worn down, and in many cases also of the lining, which is very costly. To this must be added the economic losses resulting from the idle kiln.

The object of the invention is to provide a rotary kiln of the type mentioned above, which renders it possible to prolong the life of the ribs.

The rotary kiln according to the invention is characterized by at least a part of each refractory brick in the ribs being reinforced. The effect of this arrangement is that each brick better than previously can resist the great impact forces within the kiln.

According to the invention the reinforcing bricks may be two-part units. This results in a very rapid restoration of the worn ribs, and it is unnecessary to replace the lining, since only the brick portion worn is to be replaced.

Moreover according to the invention each brick may comprise a first brick portion provided with reinforcing portions and built in the lining, the reinforcing portions preferably extending radially in the kiln, and a second brick portion secured, preferably by means of mortar, to the surface of the first brick portion facing the centre line of the kiln. This increases the strength of the two brick portions or of one brick portion only.

Furthermore according to the invention the reinforcing portions may protrude beyond the surface of the first brick portion facing the centre of the kiln, and the second brick portion may comprise recesses for receiving the reinforcing portions of the first brick portion. This enables the reinforcing portions of the first brick portion to serve as guide for the new second brick portion. This replacement is, of course, only possible when the kiln is idle and cooled.

According to the invention the recesses of the second brick portion may be through holes, whereas the reinforcing portions of the first brick portion may be bars of refractory steel turning radially inwards, and having a cross section being considerably smaller than the cross section of the holes. As a result at very simple and effective securing of the second brick portion to the first brick portion is achieved.

Moreover according to the invention the part of the reinforcing bars protruding from the first brick portion may at least be of the magnitude a fifth of the height of the secoond brick portion measured in the radial direction of the kiln, and the part of each hole of the second brick portion containing no bars may be filled with mortar for securing the two brick portions to each other. This results in a very reliable securing of the second brick portion to the first brick portion, said securing being very easy to establish. Care must, however, be taken that the mortar fills up all the cavities.

According to the invention the ratio of the cross section of the reinforcing bars to the cross section of the holes ranges preferably from 0.05 to 0.6.

Furthermore according to the invention the rear surface of each brick may extend backwards and outwards relative to the direction of rotation of the kiln. As a result the clay granules are prevented from sticking between the ribs.

Moreover according to the invention the ribs of two-part bricks may be arranged in the longitudinal direction of the kiln, and the ratio of the number of ribs to the diameter of the kiln may range from 0.5 to 5.0. This construction has proved to provide a suitable stirring of the clay in the kiln.

Finally the invention also relates to a method of manufacturing the rotary kiln according to the invention for producing an expanded clay product from clay or clay slate, said kiln comprising a firing section, the peripheral speed of which is rather great, a drying section, if any, arranged in continuation thereof, the peripheral speed of which is rather low, and ribs for moving the clay product. This method is characterized by the ribs being manufactured by first mounting complete refractory bricks provided with internal reinforcing portions, and subsequently by using the kiln for burning the clay product in such period of time that part of each brick is worn down, the reinforcing portions, however, still protruding beyond said bricks, and eventually after having stopped the kiln again, by mounting new refractory brick portions, preferably by means of mortar, on the reinforcing portions of the original brick portions. This method has proved to be very suitable for the manufacture of the rotary kiln according to the invention, since no replacement of the lining is necessary when the ribs are to be restored.

Figure 2:
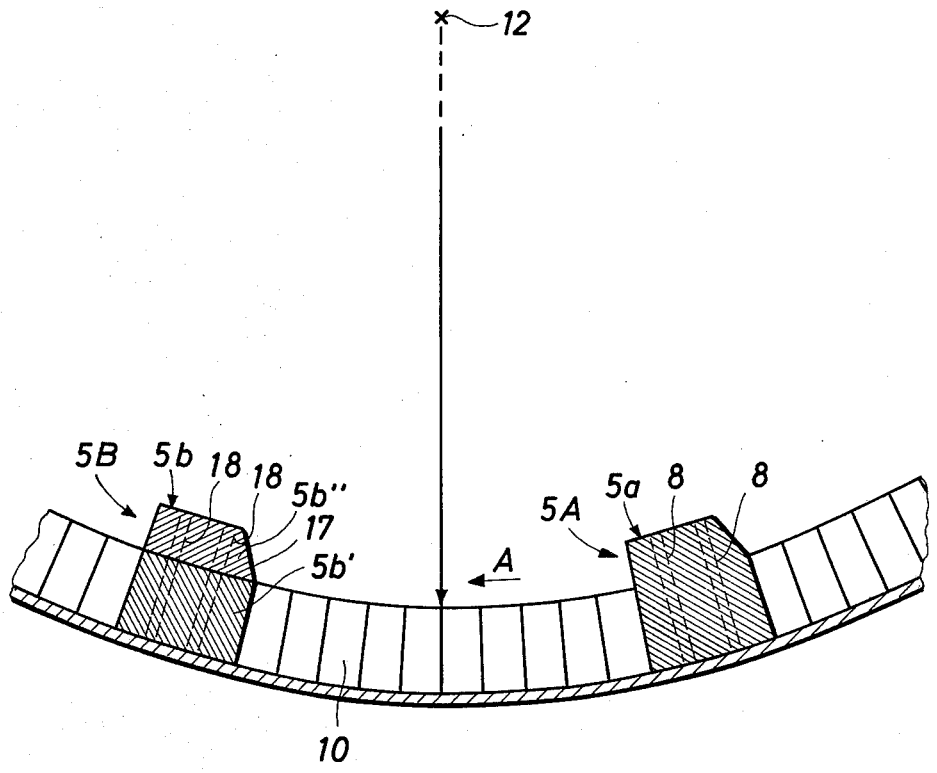
Figure 3:
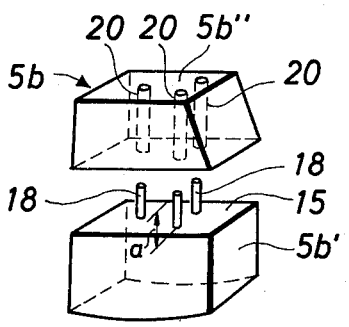
Figure 4:
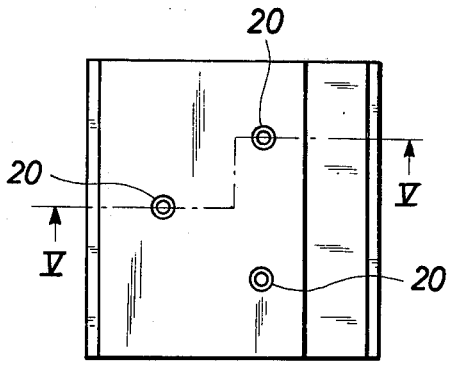
Figure 5:
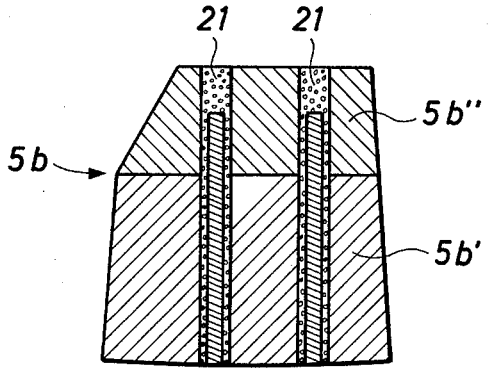

The invention will be described below with reference to the accompanying drawing, in which FIG. 1 is a diagrammatic view of the rotary kiln according to the invention, FIG. 2 is a sectional view taken along the line II—II of the rotary kiln illustrated in FIG. 1, two ribs appearing especially clearly, FIG. 3 is a special embodiment of a two-part brick forming part of the rib, FIG. 4 is a plan view of the brick illustrated in FIG. 3, and FIG. 5 is a sectional view taken along the line V—V of FIG. 4 of the brick illustrated in FIG. 4, clearly showing the dispersion of the mortar around the reinforcing portions.

The rotary kiln illustrated in FIG. 1 commprises a drying section 1 and a firing section 3. The peripheral speed of the firing section is rather great, whereas the peripheral speed of the drying section is rather low. A plurality of radially extending ribs 5A, 5B, 5C indicated by dotted lines are mounted in the firing section 3 serving to overturn the clay granules during the firing. The clay granules travel from the inlet end 7 to the discharge end 9 of the kiln. At the discharge end 9 a burner is mounted in the usual way providing the kiln with hot flue gas, the gas flowing rightwardly, whereas the clay granules travel leftwardly.

FIG. 2 is a sectional view of the two lifters 5A and 5B. Each rib may be built of complete refractory bricks as indicated by *5a* in FIG. 2 or of two-part bricks as indicated by *5b* in FIGS. 2, 3, and 5. Each brick is provided with a reinforcement indicated by dotted lines at the arrows 8 and 18. The bricks constituting the rib 5B comprise a first brick portion *5b'* of the same height as the lining 10 measured in the radial direction of the kiln, and a second brick portion *5b''* protruding somewhat towards the lengthwise centre line 12 of the kiln.

FIG. 3 is a perspective view of a brick forming part of the rib indicated by 5B. The brick portions *5b'* and *5b''* have been separated in order to illustrate the reinforcing portions 18 clearly. The reinforcing portions illustrated in the embodiment are radially protruding bars of refractory steel, having a cross section being considerably smaller than the cross section of the corresponding recesses in the second brick portion *5b''*. These recesses are in this case formed as through holes 20. The part *a* of the reinforcing bars protruding beyond the surface 15 of the first brick portion *5b'* facing the centre of the kiln is at least of the magnitude a fifth of the height of the second brick portion *5b''* measured in the radial direction of the kiln. The second brick portion *5b''* is secured to the first brick portion *5b'* by means of mortar 21 filled into the holes 20 and surrounding the reinforcing bars 18. There is nothing to prevent the brick portion *5b''* from being secured in other ways, e.g. by bolting-on or by wedging. The ratio of the cross section of the reinforcing bars 18 to the cross section of the holes 20 ranges preferably from 0.05 to 0.6.

When the brick portion *5b''* is worn down, the reinforcing bars 18 will be left, and a new second brick portion *5b''* may be built on these bars by means of mortar. This replacement may be made without necessitating a replacement of the lining and without moving the first brick portion *5b'*.

The reinforcing portions 18 may be bars having many different cross sections, e.g. round or flat iron. The first time a rib is to be built in the rotary kiln, the complete and reinforced bricks indicated by *5a* may be used, and when the part of the brick protruding beyond the lining 10 is worn down and a part of the reinforcing portion 8 protrudes, a brick portion corresponding to the brick portion *5b''* may be built in by means of mortar. The securing of these brick portions necessitates, of course, that the kiln is idle and cooled, but this way of securing reduces the idle period considerably.

It has been mentioned above that the reinforcing portions project into the second brick portion *5b''*. This is preferred, but not absolutely necessary.

The surface 17 of the second brick portion *5b''* extends backwards and outwards relative to the direction of rotation A of the kiln, thus preventing cakes of clay granules from sticking between the ribs.

In order to obtain the most effective stirring of the granules, the ratio of the number of ribs to the diameter of the kiln should preferably range from 0.5 to 5.0. The spacing of the ribs is normally constant.

FIG. 4 is a plan view of a brick forming part of a rib. This Figure clearly illustrates the arrangement of the holes 20 and of the reinforcing bars 18, and that the cross section of the bars is smaller than the cross section of the holes.

The invention may be changed in many ways without departing from the spirit and the scope of the invention.

I claim:

1. In a rotary kiln for producing an expanded clay product from clay or clay slate, comprising a firing section, the peripheral speed of which is rather great, a drying section positioned downstream from the firing section, the peripheral speed of which is rather low, and ribs formed from refractory bricks mounted in said firing section and protruding radially relative to the lining so as to move the clay product, at least a part of each refractory brick forming said ribs being reinforced, said bricks forming said ribs having first and second portions, said first portion forming at least part of the lining within said kiln and having an interior surface facing the interior of said kiln, said interior surface being at the same height as the lining measured in a radial direction, said second portion extending inwardly away from the interior surface of said first portion and means for reinforcing said first and second portions and for securing said second portion to said first portion so that said second portion is in contact with the interior surface on said first portion.

2. A rotary kiln as in claim 1 wherein said securing means includes at least one reinforcing member extending radially through said first portion and extending radially a predetermined distance beyond the interior surface of said first portion.

3. A rotary kiln as in claim 1 wherein said securing means includes a plurality of reinforcing members extending radially through said first portion and extending radially a predetermined distance beyond the interior surface of said first portion.

4. A rotary kiln as in claim 3 wherein said second portion includes means defining a plurality of recesses corresponding to the number of reinforcing members provided in said first portion for receiving the portion of said reinforcing member extending away from said surface.

5. A rotary kiln as in claim 4 wherein each of the recesses in said plurality of recesses extends through said second portion and said reinforcing members are comprised of refractory steel each having a smaller cross section than the recess in which said reinforcing member is received.

6. A rotary kiln as in claim 5 wherein said reinforcing members extend away from said surface of said first portion a distance equal to about one fifth the radial thickness of said second portion and wherein that portion of each recess within said plurality of recesses in which said reinforcing member does not extend is filled with a binder material.

7. A rotary kiln as in claim 5 wherein the ratio between the cross section of each of said reinforcing members and each recess within said plurality of recesses ranges between 0.05 to 0.6.

8. A rotary kiln as in claim 1 wherein said second portion is provided with an upper surface facing the center line of the kiln and at least one side surface extending backwardly and outwardly from said first surface.

9. A rotary kiln as in claim 1 wherein said ribs extend longitudinally within the kiln and the ratio between the number of said ribs and the diameter of the kiln ranges between 0.5 to 5.0.

10. A method of manufacturing a rotary kiln for producing an expanded clay product from clay or clay slate, said kiln having a firing section the peripheral speed of which is rather great, a drying section positioned downstream from the firing section the peripheral speed of which is rather low, and ribs formed from refractory bricks mounted in the firing section for moving the clay product, said method including the steps of: forming a first series of reinforced refractory bricks so that reinforcing members extend away from one surface of said bricks; mounting the reinforced first series of refractory bricks at predetermined locations within the kiln so that the first series of bricks forms at least part of the lining of the kiln and the surface from which the reinforcing members extend faces the center line of the kiln; forming a second series of refractory bricks having through holes corresponding in number and location to the number and position of reinforcing members extending from bricks in said first series, mounting said second series of refractory bricks on the reinforced first series of refractory bricks so that said reinforcing members mesh with and extend at least part way into the holes provided in bricks comprising said second series of bricks, securing the second series of bricks to the reinforcing members extending away from the first series of reinforcing bricks so that bricks within said second series of refractory bricks can be replaced in a like manner when worn down to the level of the reinforcing members.

* * * * *